US009691572B2

(12) United States Patent
Toh

(10) Patent No.: US 9,691,572 B2
(45) Date of Patent: Jun. 27, 2017

(54) KEY BUTTON

(75) Inventor: Tadamine Toh, Kawasaki (JP)

(73) Assignee: NEC Platforms, Ltd., Kawasaki-shi, Kanagawa (JP)

( * ) Notice: Subject to any disclaimer, the term of this patent is extended or adjusted under 35 U.S.C. 154(b) by 24 days.

(21) Appl. No.: 13/577,319

(22) PCT Filed: Jan. 19, 2011

(86) PCT No.: PCT/JP2011/050861
§ 371 (c)(1),
(2), (4) Date: Aug. 6, 2012

(87) PCT Pub. No.: WO2011/102174
PCT Pub. Date: Aug. 25, 2011

(65) Prior Publication Data

US 2012/0307479 A1 Dec. 6, 2012

(30) Foreign Application Priority Data

Feb. 18, 2010 (JP) ..... 2010-033592

(51) Int. Cl.
*H01H 13/83* (2006.01)
*H01H 9/18* (2006.01)

(52) U.S. Cl.
CPC ..... *H01H 13/83* (2013.01); *H01H 9/182* (2013.01); *H01H 2009/183* (2013.01); *H01H 2219/028* (2013.01); *H01H 2219/062* (2013.01); *H01H 2219/064* (2013.01); *H01H 2219/0622* (2013.01); *H01H 2229/046* (2013.01)

(58) Field of Classification Search
CPC ..... G01D 11/28; B60K 37/02; B60Q 3/044; F21S 8/035; H01R 13/717; F21V 23/0442
USPC ..... 362/23, 23.01, 24, 95
See application file for complete search history.

(56) References Cited

U.S. PATENT DOCUMENTS 5,120,920 A 6/1992 Moriike
5,196,230 A * 3/1993 Okonogi ..... H05K 1/0218 174/264
5,510,782 A * 4/1996 Norris et al. ..... 341/22
5,951,349 A * 9/1999 Larose et al. ..... 445/22
(Continued)

FOREIGN PATENT DOCUMENTS

CN 1427432 A 7/2003
CN 1511328 A 7/2004
(Continued)

OTHER PUBLICATIONS

International Search Report for PCT/JP2011/050861 dated Mar. 29, 2011.

(Continued)

*Primary Examiner* — Jong-Suk (James) Lee
*Assistant Examiner* — Mark Tsidulko
(74) *Attorney, Agent, or Firm* — Sughrue Mion, PLLC

(57) ABSTRACT

Disclosed is key button (4) that includes a display surface on which character section (A) is formed, and a side face extending in a direction to intersect the display surface. The key button further includes transmission section (6) made of a light transmissive material, which constitutes the display surface and the side face, and shielding section (7) made of a light shielding material, which covers only a part of transmission section (6) other than character section (A) of the display surface.

4 Claims, 1 Drawing Sheet

(56) References Cited

U.S. PATENT DOCUMENTS

| | | | | |
|---|---|---|---|---|
| 5,993,019 | A * | 11/1999 | Kline et al. | 362/29 |
| 7,073,916 | B2 * | 7/2006 | Yin et al. | 362/84 |
| 7,105,759 | B1 | 9/2006 | Mucha | |
| 7,183,511 | B2 * | 2/2007 | Ikeda et al. | 200/314 |
| 2003/0202337 | A1 | 10/2003 | Yin et al. | |
| 2005/0168966 | A1 * | 8/2005 | Maeda | H01H 25/041 362/23.05 |
| 2007/0103453 | A1 * | 5/2007 | Choo et al. | 345/173 |

FOREIGN PATENT DOCUMENTS

| | | | |
|---|---|---|---|
| JP | 63-76929 | U | 5/1988 |
| JP | 2004-39327 | A | 2/2004 |
| JP | 2004-193891 | A | 7/2004 |
| JP | 2004-338183 | A | 12/2004 |
| JP | 2009-181893 | A | 8/2009 |

OTHER PUBLICATIONS

Extended European Search Report, dated Feb. 27, 2014, issued by the European Patent Office, in counterpart Application No. 11744463.8.

Chinese Office Action issued in Chinese Application No. 201180010109.8 dated Mar. 20, 2013.

Communication dated Nov. 17, 2014, issued by the Australian Intellectual Property Office, in counterpart Application No. 2011216712.

* cited by examiner

KEY BUTTON

CROSS REFERENCE TO RELATED APPLICATIONS

This application is a National Stage of International Application No. PCT/JP2011/050861 filed Jan. 19, 2011, claiming priority based on Japanese Patent Application No. 2010-033592 filed Feb. 18, 2010, the contents of all of which are incorporated herein by reference in their entirety.

TECHNICAL FIELD

The present invention relates to a key button used for a communication device or the like.

BACKGROUND ART

For the communication device, particularly a communication device used at home, such as a telephone or a facsimile, not only its function and performance but also its design are important. Taking the example of the telephone, various key buttons that are pressed to make a call have been devised to improve designability. For example, a light transmissive material is used for a character part to describe the numerals of the key buttons such as 1, 2, . . . , a material through which light is difficult to pass is used around the character part, and a transmission section and a shielding section are formed by two-color injection molding. Accordingly, when the light of a backlight is applied from the inside of the key button, the light is transmitted from the inside of the key button through the character part to be discharged to the outside. As a result, the character part can stand out (e.g., Patent Literature 1).

CITATION LIST

Patent Literature

Patent Literature 1: JP2004-338183A

SUMMARY OF INVENTION

Problems to be Solved by Invention

However, in the key button formed through the two-color injection molding according to the method disclosed in Patent Literature 1 or the like, when a material that almost blocks the light, such as a black material, is used for the shielding section, a problem occurs in the unused state of the backlight. Hereinafter, this problem is described by referring to a related technology shown in FIGS. 1A and 1B.

FIGS. 1A and 1B schematically shows the configuration of an example of a key button according to the related technology: FIG. 1A is a top view, and FIG. 1B is a schematic sectional view cut along the line Y-Y' shown in FIG. 1A.

Rubber contact switch 12 is disposed on substrate 11, and key button 14 is disposed on switch section 13 of rubber contact switch 12. Key button 14 is surrounded with housing 15. Key button 14, which is hollow, includes character section B that projects outward (opposite the hollow section), three-dimensional transmission section 16 that is made of a material to transmit light, shielding section 17 that covers the surroundings of transmission section 16 except character section B. When a color that almost blocks the light, such as a black color material, is used for shielding section 17, the light from the outside of key button 14 is blocked by shielding section 17 so that it is unable to enter into key button 14. Thus, there is almost no light that enters from the outside of key button 14, and is reflected inside key button 14 to be discharged from character section B to the outside. As a result, when backlight 18 is not used, character section B is assimilated into surrounding black shielding section 17, thus making it difficult to recognizing character section B.

The present invention provides a key button that solves the difficulty of recognizing a character when a character section is made of a material that transmits light and when the surroundings of the character section are covered with a material that almost blocks the light.

Solution to Problems

The key button according to the present invention includes a transmission section made of a light transmissive material, which constitutes a display surface on which a character section is formed, and a side face extending in a direction to intersect the display surface, and a shielding section made of a light shielding material, which covers only a part of the transmission section other than the character section of the display surface.

Effects of Invention

According to the present invention, even when the backlight is not used, the character of the key button can be easily recognized.

BRIEF DESCRIPTION OF DRAWINGS

FIG. 1A is a top view, and FIG. 1B is a sectional view cut along the line Y-Y' shown in FIG. 1A.

FIG. 2A is a top view, and FIG. 2B is a sectional view cut along the line X-X' shown in FIG. 2A.

DESCRIPTION OF EMBODIMENTS

Figure 1A:
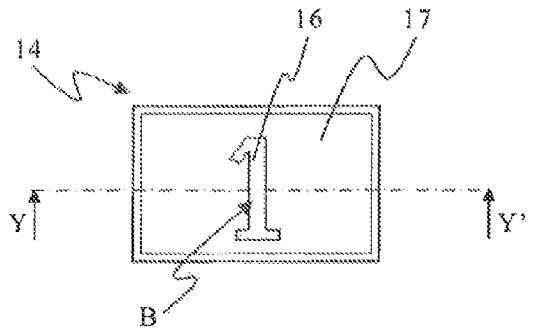
FIGS. 1A and 1B schematically show the configuration of an example of a key button according to the related technology.
Figure 1B:
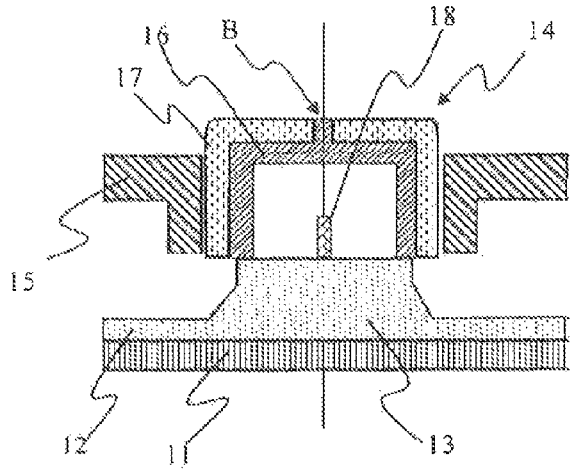
Prior Art Fig.1B

Hereinafter, the embodiment of the present invention is described with reference to the accompanying drawings. Components having similar functions are denoted by similar reference numerals in the accompanying drawings, and description thereof is omitted.

Figure 2A:
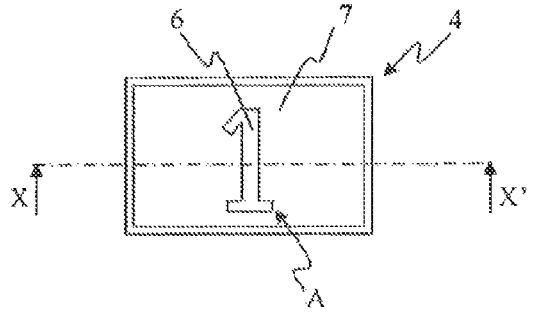
Prior Art Fig.2A
FIGS. 2A and 2B schematically show the configuration of a key button according to the embodiment of the present invention.
Figure 2B:
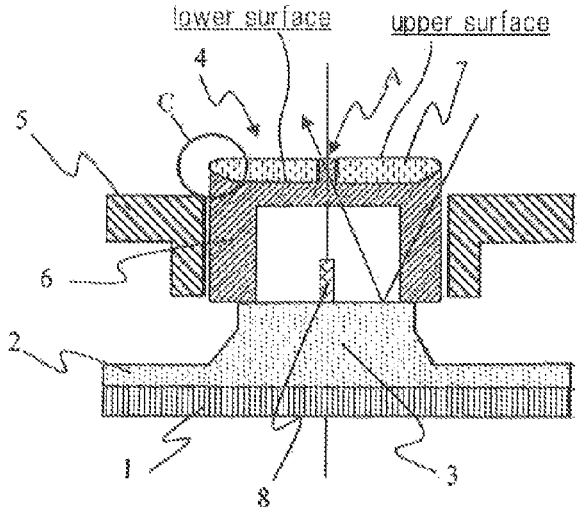

FIGS. 2A and 2B schematically show the configuration of a key button according to the embodiment of the present invention: FIG. 2A is a top view, and FIG. 2B is a sectional view cut along the line X-X' shown in FIG. 2A.

Rubber contact switch 2 is disposed on substrate 1. Rubber contact switch 2 includes switch section 3 that projects in a direction opposite substrate 1. On switch section 3, hollow and three-dimensional key button 4 is disposed, which includes character section A projecting in a direction opposite switch section 3, namely, outward (opposite the hollow section). Key button 4 includes transmission section 6 that is made of a material to transmit light, and shielding section 7 made of a material that almost blocks the light and that is configured to cover parts of the surface of transmission section 6 where character section A is formed except character section A. Key button 4 is surrounded with housing 5. The surface where character section A is formed becomes a display surface to enable the user to recognize a character. Backlight 8 such as a LED (Light Emitting Diode) is disposed inside key button 4.

Because it is surrounded with housing 5, the horizontal movement of key button 4 is limited with respect to the surface having character section A whereas key button 4 is permitted to move in a vertical direction. When key button 4 is pressed by the user, key button 4 pushes switch section 3 of rubber contact switch 2 into substrate 1 side. Then, though not shown, a connector in switch section 3 and a connector in substrate 1 are brought into contact with each other to transmit a signal.

Next, key button 4 is described.

As described above, key button 14 of the related technology is hollow, and the surroundings of three-dimensional transmission section 16 having character section B projecting outward are covered, except for character section B, with shielding section 17.

On the other hand, shielding section 7 of key button 4 according to the present invention covers the parts of the surface of transmission section 6 where character section A is formed other than character section A. Accordingly, the surface of transmission section 6 other than the surface where character section A is formed is not covered with shielding section 7. The surface of transmission section 6 in contact with shielding section 7 is located higher than the surface of housing 5 opposite substrate 1, namely, its outer surface. Accordingly, a part of the side face extending in a direction to intersect the display surface (in the example shown in FIGS. 2A and 2B, orthogonal direction) is exposed without being covered with shielding section 7 or housing 5. This part becomes an inlet through which light enters into transmission section 6 of key button 4 from the outside.

The surface (lower surface) of shielding section 7 in contact with transmission section 6 and the surface (upper surface) opposite the surface in contact with transmission section 6 can be set parallel to each other. As shown in section C of FIG. 2B, it is preferable that the lower surface of shielding section 7 be refracted to the upper surface side at the end of the outer peripheral side of shielding section 7.

The material that is used for transmitting light can be a transparent resin material, and the material that is used for almost blocking the light can be a black resin material. However, the materials are not limited to these.

In key button 4 thus configured, in a part of the side face of transmission section 6, namely, the direction orthogonal to the display surface, a portion through which the light can enter from the outside of key button 4 is formed between the surface of transmission section 6 in contact with shielding section 7 and the outer surface of housing 5.

As indicated by an arrow shown in FIG. 2B, the light can enter into key button 4 from the outside, and the light reflected inside key button 4 can be discharged from character section A to the outside of key button 4. Accordingly, even when backlight 8 is not used, the difficulty of recognizing character section B that occurs in key button of 14 of the related technology unless backlight 18 is used can be prevented. Further, at the end of shielding section 7 opposite character section A, when the lower surface of shielding section 7 is refracted to the upper surface, light enters into key button 4 from the outside more easily. As a result, character section A can be recognized more easily even when backlight 8 is not used.

With this configuration, in key button 4 according to the present invention, even when shielding section 7 has a color to greatly block the light of a black color or the like, the light can enter into key button 4 from the outside, and the light reflected in key button 4 can be discharged from character section A. As a result, even when backlight 8 is not used, character section A can be recognized more easily.

According to this embodiment, the structure of transmission section 6 of key button 4 is hollow. However, transmission section 6 can be solid, and backlight 8 can be located not inside but behind key button 4. Further, character section A can be formed so that it does not project from the surface of transmission section 6 but such that the surface of transmission section 6, where character section A is located, is formed planar, and such that covering only part of character section A with shielding section 7 is prevented.

Key button 4 according to the present invention can be formed by executing two-color molding at a normal injection molding device without using any special manufacturing device. Thus, manufacturing costs are not greatly increased. Further, key button 4 according to the present invention can be formed by a method other than the two-color molding method.

The key button according to the present invention is not limited to the key button for the communication device such as a telephone. Key button 4 according to the present invention can be applied to any device as long as it is permitted.

This application claims priority from Japanese Patent Application No. 2010-033592 filed Feb. 18, 2010, which is hereby incorporated by reference herein in its entirety.

The invention claimed is:

1. A key button comprising:

a transmission section made of a light transmissive material, which constitutes one display surface on which a character section is formed, and a side face extending in a direction to intersect the display surface; and a shielding section made of a light shielding material, which covers only the display surface of the transmission section other than the character section and does not cover the side face of the transmission section, wherein the shielding section has an inverted trapezoidal shape with respect to a cross section taken in a plane perpendicular to the display surface.

2. The key button according to claim 1, wherein the transmission section of the key button includes a hollow section in which a backlight is disposed, and the character section is formed to project from a surface of the transmission section oppositely to the hollow section.

3. A device comprising:

a key button comprising:

a transmission section made of:

a light transmissive material, which constitutes one display surface on which a character section is formed, and a side face extending in a direction to intersect the display surface; and a shielding section, made of a light shielding material, which covers only the display surface of the transmission section other than the character section and does not cover the side face of the transmission section, wherein:

the shielding section has an inverted trapezoidal shape with respect to a cross section taken in a plane perpendicular to the display surface; and a housing that surrounds the key button, wherein, in a direction orthogonal to the display surface, the surface of the transmission section in contact with the shielding section is located outside an outer surface of the housing.

4. A character displaying method, for a key button, comprising:

providing a transmission section made of a light transmissive material, which constitutes one display on which a character section is formed, and a side face extending in a direction to intersect the display surface; and providing a shielding section made of a light shielding material, which covers only the display surface of the transmission section other than the character section and does not cover the side face of the transmission section;

wherein the shielding section has an inverted trapezoidal shape with respect to a cross section taken in a plane perpendicular to the display surface.

* * * * *